US005816862A

United States Patent [19]

Tseng

[11] Patent Number: 5,816,862

[45] Date of Patent: Oct. 6, 1998

[54] LIGHT BULB SOCKET HOLDER

[76] Inventor: Jeou-nan Tseng, No. 539, Sec. 4, Chunghua Rd., Hsinchu, Taiwan

[21] Appl. No.: 665,912

[22] Filed: Jun. 19, 1996

[51] Int. Cl.[6] ..... H01R 17/00

[52] U.S. Cl. ..... 439/699.2

[58] Field of Search ..... 439/699.2, 242, 439/243, 617, 619, 230, 280, 519, 521

[56] References Cited

U.S. PATENT DOCUMENTS 5,278,741 1/1994 Ehrman ..... 439/619

5,620,343 4/1997 Pan ..... 439/699.2

*Primary Examiner*—Gary F. Paumen

*Assistant Examiner*—Yong Ki Kim

*Attorney, Agent, or Firm*—Foley & Lardner

[57] ABSTRACT

A tubular socket and a cylindrical hollow holder for providing support to the tubular socket are provided. The tubular socket and the cylindrical hollow holder are especially designed for use with decorative lights. The cylindrical hollow holder further has a plug designed to fit into a space between wires which are attached to an inner peripherial wall of the cylindrical hollow holder. The plug is formed either integrally with the tubular socket or independently. An outer cover has an inner space into which the cylindrical hollow holder is tightly received.

3 Claims, 6 Drawing Sheets

LIGHT BULB SOCKET HOLDER

FIELD OF THE INVENTION

The present invention generally relates to a light bulb socket holder, and more particularly to a socket holder having a water proof structure.

BACKGROUND OF THE INVENTION

This invention has a particular application to a light bulb socket holder which is used for Christmas light bulbs.

People often like to decorate their houses on festive occasions, such as Christmas or want other people to share their joy about some special occasion, so they will use small light bulbs as decorations to the outside of their houses. It is common to our knowledge that when the light bulb of this kind is hung up above the ground, a base end of the socket holder is facing upward and the light bulb is then facing to the ground. Therefore, after the light bulb socket holder has been hung up outside for a while, the moisture in the air, or rain drops will seep into the socket holder from a cable carrying electrical current which is inserted into the socket holder and a short circuit may result.

A conventional socket holder is constructed to have two wires to perform electrical conduction between a ring contact and a tip contact of a bulb and these two wires are separate from each other. Yet, if rain drops seep into the socket holder and, eventually the moisture in the air will infiltrate into the socket holder and cause a short circuit between these two wires, the ring contact and tip contact of the bulb, which sometimes causes only minor damage to the circuit, but othertimes will lead to a disaster.

Thus, the light bulb socket holder of the present invention tends to mitigate and/or obviate the aforementioned problems.

SUMMARY OF THE INVENTION

The main objective of the invention is to provide a waterproof light bulb socket holder having a plug inserted into a hole which receives two wires therein.

Another objective of the invention is to provide a socket which can directly be securely combined with the socket holder without using extra clamping members to achieve the fixing and water proof effect.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
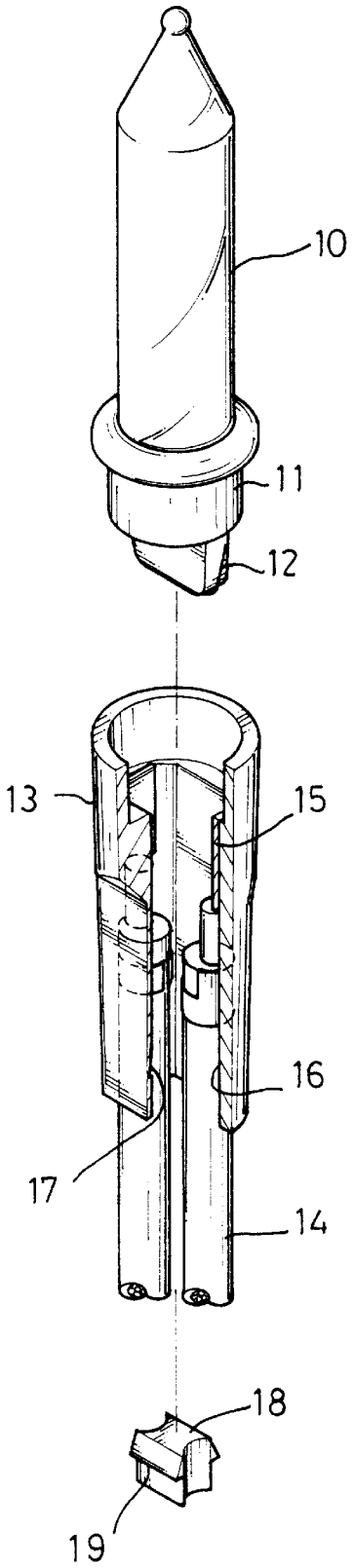
FIG. 1 is a partially cut away perspective view of a light bulb socket holder in accordance with the present invention and a plug configured to fit into the socket holder.
Figure 2:
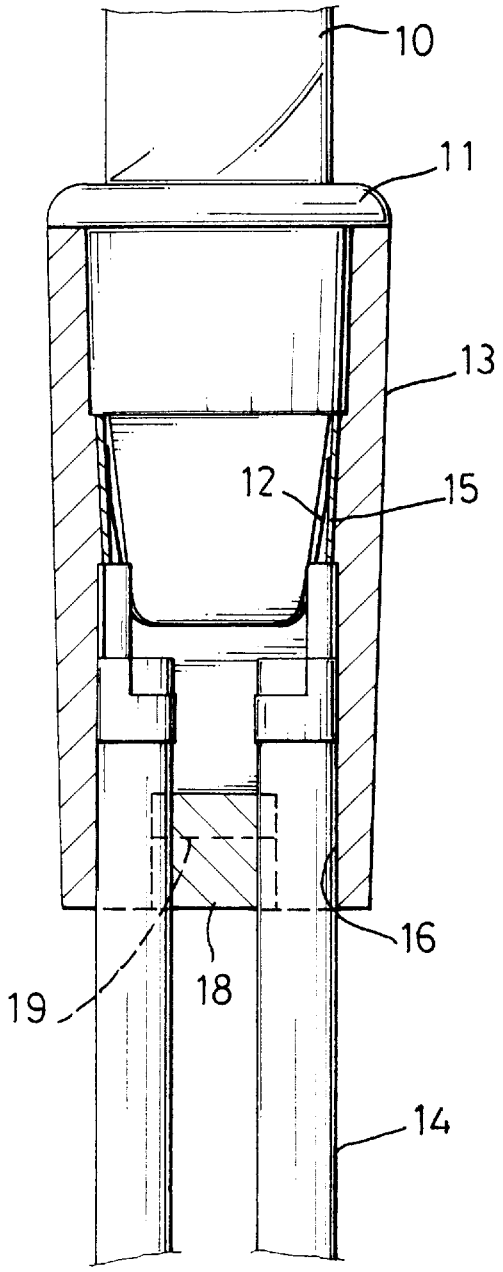
FIG. 2 is a partially sectional view of FIG. 1.

Referring to FIGS. 1 and 2, one preferred embodiment of the invention is shown. A light bulb 10 is securely received within a tubular socket 11 which is configured to have conducting elements 12 on both sides. A cylindrical hollow holder 13 for receiving the tubular socket 11 is provided with a plurality of conducting plates 15 securely attached to an inner periphery. A plurality of wires 14 which carry an electric current are thus connected to the conducting plates 15. When the tubular socket 11 is inserted into the cylindrical hollow holder 13, the conducting elements 12 on both sides of the tubular socket 11 will engage with the respective conducting plates 15 attached to an inner periphery of the holder 13. Because the conducting plates 15 are securely connected with the wires 14, the light bulb 10 is thus lit. The above mentioned structure is well known to people who are skilled in the art, therefore, it is not necessary to describe it in any detail.

Although the prior structure is simple and handy in structure, it is likely that moisture in the air will gradually seep into the holder 13 from the gap between the wires 14 and cause a short circuit. To prevent this, a plug 18 is provided. Two sides of the plug 18 are defined and configured to closely receive the wires 14, and the opposite sides each are then provided with a wedged boss 19 which is to cooperate with a notch 17 formed integrally on an inner periphery of the cylindrical hollow holder 13. A thus-structured plug 18 is able to prevent moisture from seeping into the cylindrical hollow holder 13, after the plug 18 is tucked into the cylindrical hollow holder 13 along the wires 14 and from a bottom face (not numbered) of the holder 13, with the wedged boss 19 fixedly received within the notch 17.

Figure 3:
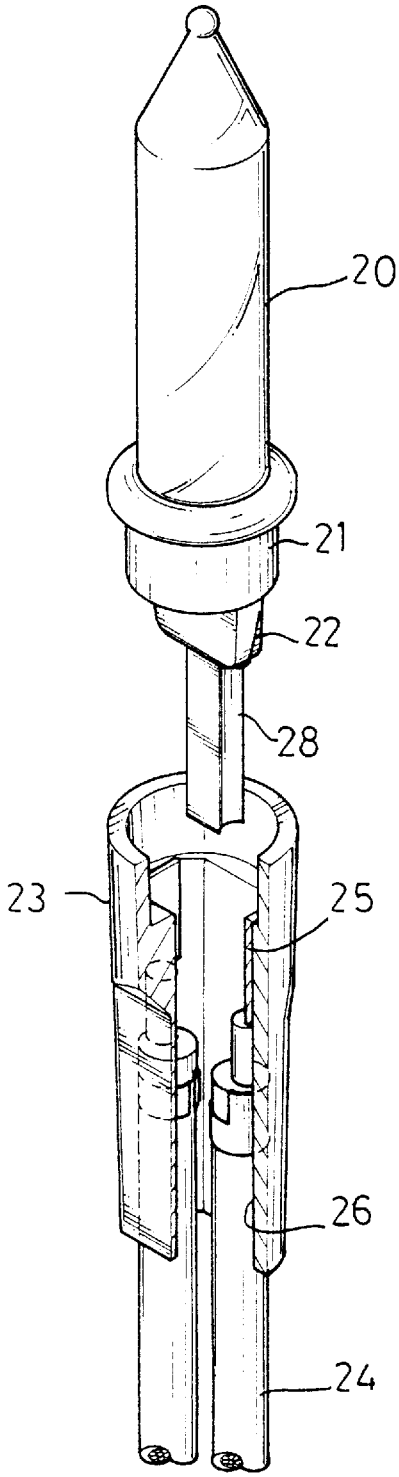
FIG. 3 is a partially cut away perspective view of a light bulb socket configured in accordance with the invention and a prior socket holder.
Figure 4:
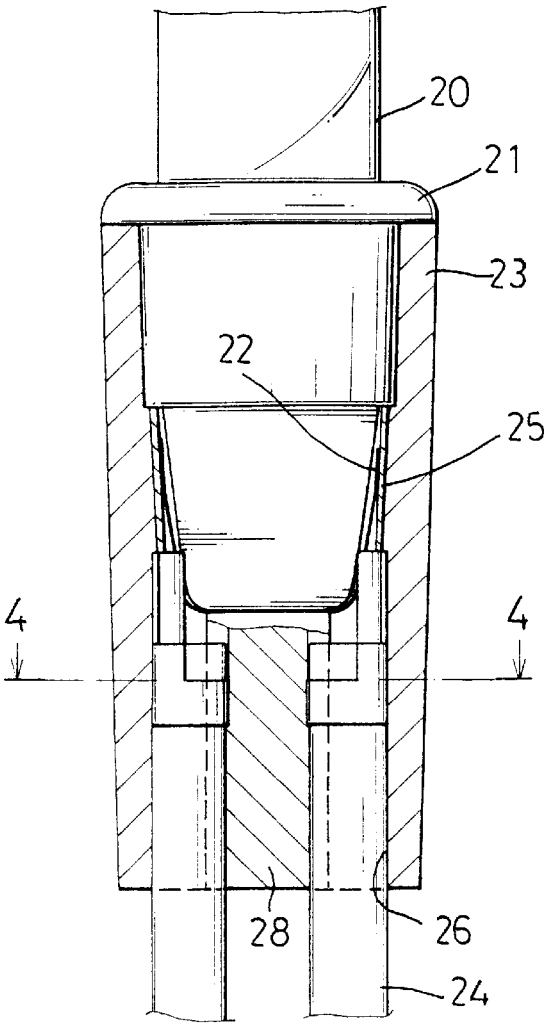
FIG. 4 is a sectional view of FIG. 3 when the socket and the socket holder are assembled together.
Figure 5:
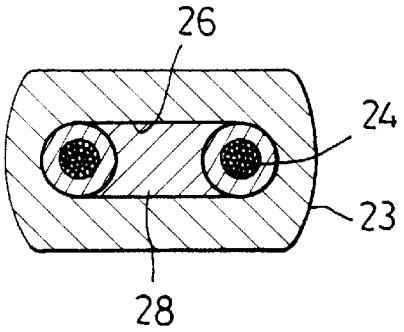
FIG. 5 is an end view of FIG. 4 taken along line 4—4.

Referring to FIGS. 3, 4 and 5, another embodiment of the invention is shown. From these particular drawings, it is to be noted that, despite the structure of a cylindrical hollow holder 23 which has conducting plates 25 securely attached to an inner periphery and a plurality of wires 24 fixedly connected with the conducting plates 25 therein, a socket 21 having a light bulb 20 connected therein is configured to have conducting elements 22 on two opposite sides and a rectangle-like extension 28 directly provided on a bottom face. The rectangle-like extension 28 has two concave opposite end faces, so that the extension 28 is able to prevent moisture from seeping into the cylindrical hollow holder 23, after the extension 28 is tucked into the cylindrical hollow holder 23 from an upper face of the holder 23. The connection relationship between the extension 28 and the cylindrical hollow holder 23 with wires 24 received within a recess 26 is best shown in FIG. 5. The extension 28 is configured to be able to occupy all the space between the wires 24 each seated within a recess 26, such that when the extension 28 is inserted into the holder 23, moisture will no longer be possible to seep into the holder 23 from the bottom face.

Figure 6:
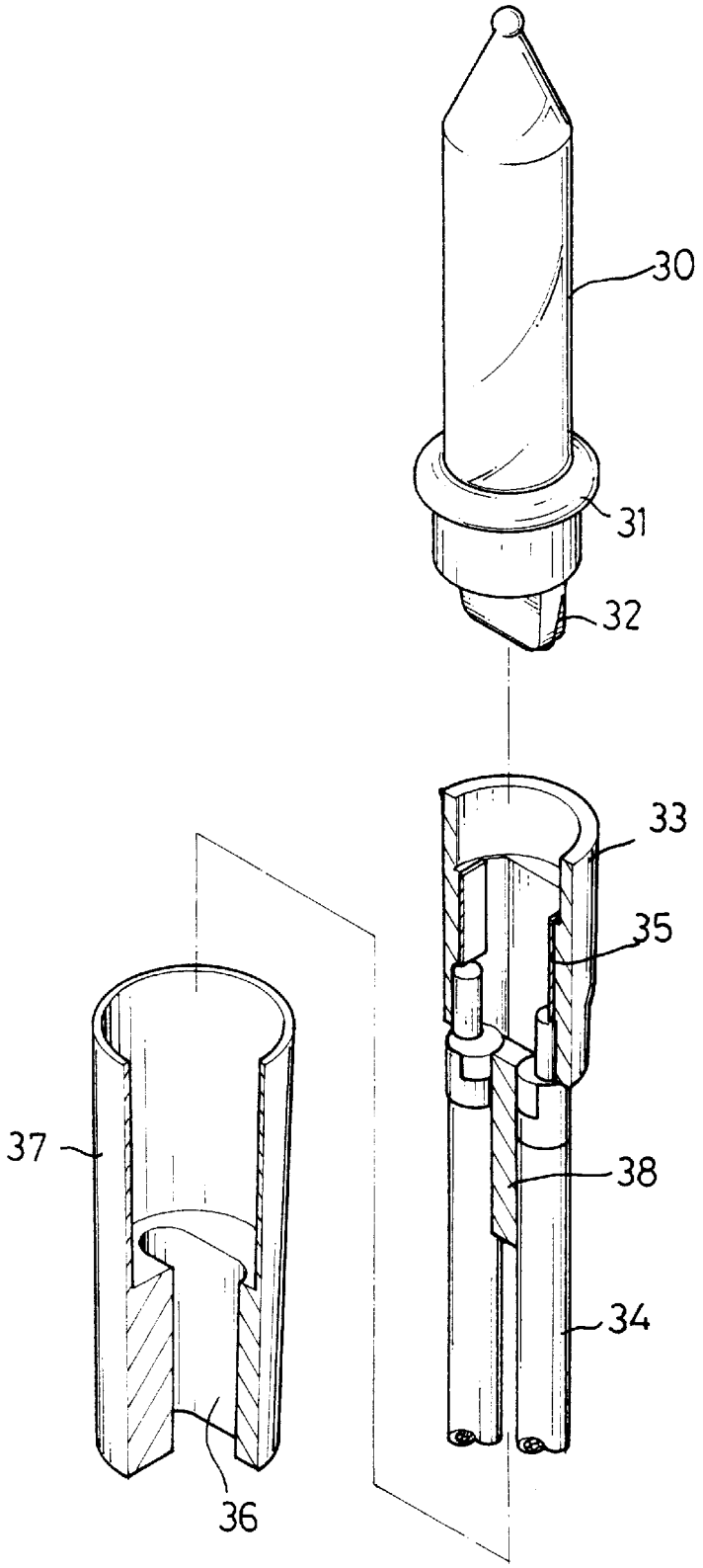
FIG. 6 is a prior light bulb socket and a socket holder constructed in accordance with another embodiment of the invention.
Figure 7:
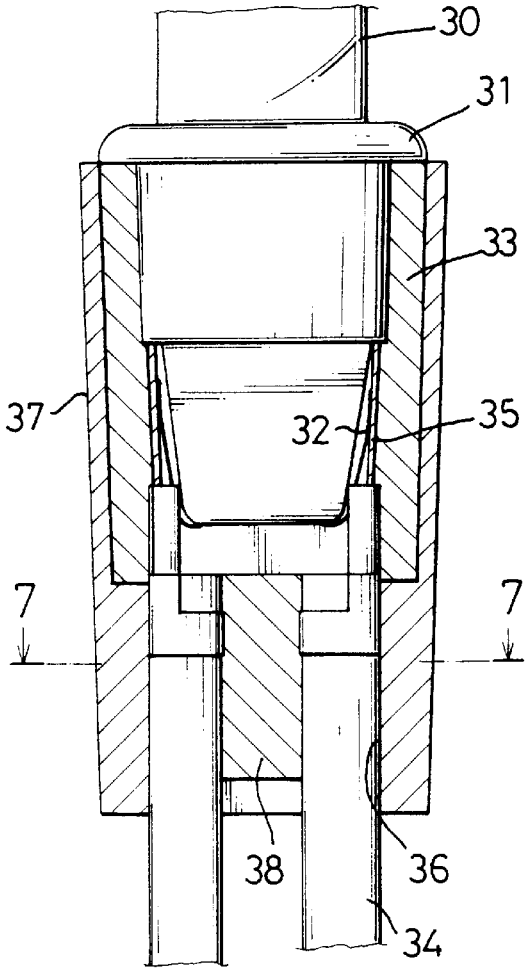
FIG. 7 is a sectional view of FIG. 6 when the socket and the socket holder are assembled together.
Figure 8:
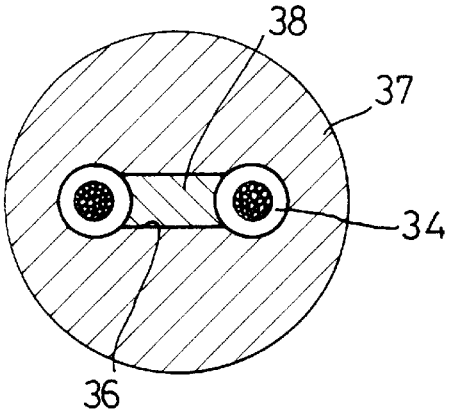
FIG. 8 is an end view of FIG. 7 taken along line 7—7.

Still another embodiment of the invention is shown in FIGS. 6, 7 and 8. A light bulb 30 is securely connected with a tubular socket 31 having conducting elements 32 on both sides. A cylindrical hollow holder 33 is provided with a plurality of conducting plates 35 securely attached to an inner periphery thereof and a plurality of wires 34 each connecting with the conducting plates 35 and having a plug

38 tightly inserted therebetween. Beside the above mentioned members, the invention also comprises an outer cylindrical cover 37. An inner space 36 of the outer cylindrical cover 37 is configured to mate with the cylindrical hollow holder 33, when the cylindrical hollow holder 33 is inserted into the outer cylindrical cover 37. From the accompanying drawings, and especially from FIG. 8, the inner space 36 of the outer cylindrical cover 37 is fully occupied by the cylindrical hollow holder 33, when the outer cylindrical cover 37 is inserted into the cylindrical hollow holder 33.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A light bulb socket holder comprising:

a tubular socket having at least two conducting elements on opposite sides of a bottom face thereof;

a cylindrical hollow holder for tightly receiving said tubular socket having at least two connecting plates securely attached to a face of an inner periphery and at least two separate wires securely connected with said connecting plates; and a plug integrally formed with said tubular socket and configured and sized to fill into a gap between said wires.

2. The light bulb socket holder as claimed in claim 1, wherein the plug is a rectangle-like extension.

3. The light bulb socket holder as claimed in claim 2, wherein the rectangle-like extension has two concave opposite end faces.

* * * * *